US009337624B2

(12) United States Patent
Ma

(10) Patent No.: US 9,337,624 B2
(45) **Date of Patent: *May 10, 2016**

(54) ELECTRODE MATERIAL FOR A SPARK PLUG AND METHOD OF MAKING THE SAME

(71) Applicant: FEDERAL-MOGUL IGNITION COMPANY, Southfield, MI (US)

(72) Inventor: Shuwei Ma, Ann Arbor, MI (US)

(73) Assignee: FEDERAL-MOGUL IGNITION COMPANY, Southfield, MI (US)

( * ) Notice: Subject to any disclaimer, the term of this patent is extended or adjusted under 35 U.S.C. 154(b) by 117 days.

This patent is subject to a terminal disclaimer.

(21) Appl. No.: 14/048,368

(22) Filed: Oct. 8, 2013

(65) Prior Publication Data

US 2014/0103792 A1 Apr. 17, 2014

Related U.S. Application Data

(60) Provisional application No. 61/713,271, filed on Oct. 12, 2012.

(51) Int. Cl.
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
USPC ..... 313/141, 326, 352, 311; 123/169 EL
See application file for complete search history.

(56) References Cited

U.S. PATENT DOCUMENTS

| | | | | |
|---|---|---|---|---|
| 2,391,458 | A | 3/1944 | Hensel | |
| 2,476,208 | A | 10/1944 | Middleton | |
| 2,894,838 | A | 7/1959 | Gregory | |
| 3,278,280 | A | 10/1966 | Holtz, Jr. et al. | |
| 3,498,763 | A | 3/1970 | Savage | |
| 4,324,588 | A | 4/1982 | Zysk et al. | |
| 4,427,915 | A | 1/1984 | Nishio et al. | |
| 4,539,503 | A * | 9/1985 | Esper | H01T 13/20 313/11.5 |
| 4,670,684 | A | 6/1987 | Kagawa et al. | |
| 5,347,193 | A | 9/1994 | Oshima | |
| 5,603,075 | A | 2/1997 | Stoll et al. | |
| 5,802,955 | A | 9/1998 | Stoll et al. | |
| 5,853,622 | A | 12/1998 | Gallagher | |
| 5,902,429 | A | 5/1999 | Apte et al. | |
| 7,041,250 | B2 | 5/2006 | Sherman et al. | |
| 7,382,084 | B2 | 6/2008 | Yoshimoto et al. | |
| 7,527,877 | B2 | 5/2009 | Gorman et al. | |
| 7,719,172 | B2 | 5/2010 | Boehler et al. | |

(Continued)

FOREIGN PATENT DOCUMENTS

DE 10348778 10/2003

*Primary Examiner* — Ashok Patel
(74) *Attorney, Agent, or Firm* — Reising Ethington, P.C.

(57) ABSTRACT

An electrode material that may be used in spark plugs and other ignition devices for igniting an air/fuel mixture in an engine. The electrode material has a metal ceramic composite structure and includes a particulate component embedded or dispersed within a matrix component such that the electrode material has a multi-phase microstructure. In an exemplary embodiment, the matrix component includes platinum (Pt) and one or more additive metals like nickel (Ni) or palladium (Pd), and the particulate component includes an electrically conductive ceramic, such as titanium diboride ($TiB_2$). A liquid phase or a solid phase sintering process may be used, depending on the particular constituency of the electrode material.

10 Claims, 4 Drawing Sheets

(56) References Cited

U.S. PATENT DOCUMENTS

| | | | | |
|---|---|---|---|---|
| 7,808,165 | B2 * | 10/2010 | Kowalski | H01T 13/32 123/169 R |
| 8,044,561 | B2 * | 10/2011 | Walker, Jr. | H01T 21/02 313/11.5 |
| 2003/0044307 | A1 | 3/2003 | Crombie, III | |
| 2007/0236125 | A1 | 10/2007 | Lykowski et al. | |
| 2008/0308057 | A1 * | 12/2008 | Lykowski | B23K 35/3066 123/169 EL |
| 2011/0012498 | A1 | 1/2011 | Ma et al. | |
| 2012/0126682 | A1 * | 5/2012 | Walker, Jr. | H01T 13/20 313/141 |
| 2012/0194056 | A1 | 8/2012 | Ma et al. | |
| 2012/0212119 | A1 | 8/2012 | Ma et al. | |

* cited by examiner

ELECTRODE MATERIAL FOR A SPARK PLUG AND METHOD OF MAKING THE SAME

REFERENCE TO RELATED APPLICATIONS

This application claims the benefit of U.S. Provisional Ser. No. 61/713,271 filed Oct. 12, 2012, the entire contents of which are incorporated herein.

TECHNICAL FIELD

This invention generally relates to spark plugs and other ignition devices for internal combustion engines and, in particular, to electrode materials for use therewith.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one aspect, there is provided a spark plug comprising: a metallic shell having an axial bore, an insulator having an axial bore and being at least partially disposed within the axial bore of the metallic shell, a center electrode being at least partially disposed within the axial bore of the insulator, and a ground electrode being attached to a free end of the metallic shell. The center electrode, the ground electrode or both may include an electrode material with a metal ceramic composite structure that has a particulate component embedded in a matrix component, and the matrix component includes a platinum-based material and the particulate component includes an electrically conductive ceramic.

According to another aspect, there is provided a method of preparing an electrode material for a spark plug. The method may comprise the steps of: (a) providing platinum (Pt) and at least one additive metal in powder form; (b) providing an electrically conductive ceramic in powder form; (c) blending the platinum (Pt), the at least one additive metal, and the electrically conductive ceramic to form a powder mixture; and (d) sintering the powder mixture to form an electrode material with a metal ceramic composite structure that has a particulate component embedded in a matrix component. The matrix component includes the platinum (Pt) and the at least one additive metal and the particulate component includes the electrically conductive ceramic.

According to another aspect, there is provided another method of preparing an electrode material for a spark plug. This method may comprise the steps of: (a) providing a matrix material in powder form, the matrix material includes a predetermined amount of platinum (Pt) and a predetermined amount of at least one additive metal selected from the group consisting of nickel (Ni) or palladium (Pd), the platinum (Pt) is the single largest constituent of the matrix material on a wt % basis; (b) providing a particulate material in powder form, the particulate material includes a predetermined amount of at least one electrically conductive ceramic selected from the group consisting of: titanium diboride ($TiB_2$), zirconium diboride ($ZrB_2$), or hafnium diboride ($HfB_2$); (c) blending the matrix material and the particulate material together to form a powder mixture; and (d) sintering the powder mixture to form an electrode material with a metal ceramic composite structure that has a matrix component and a particulate component embedded in the matrix component. The matrix component includes the platinum (Pt) and the at least one additive metal and the particulate component includes the at least one electrically conductive ceramic.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
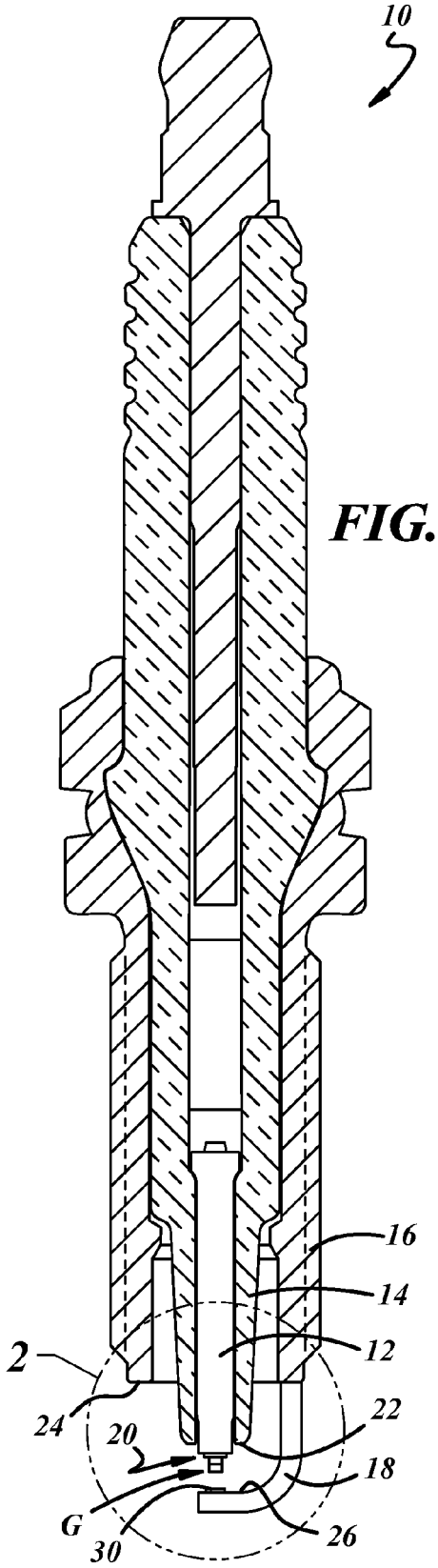
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
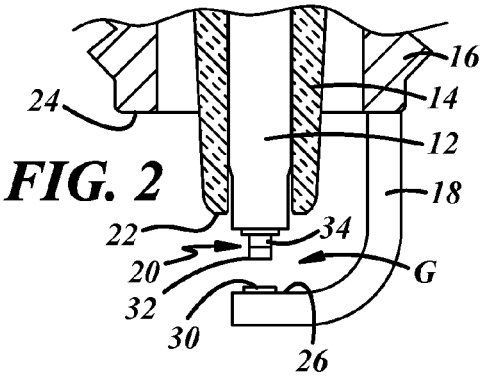
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
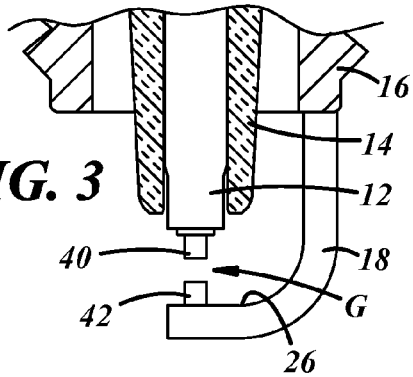
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
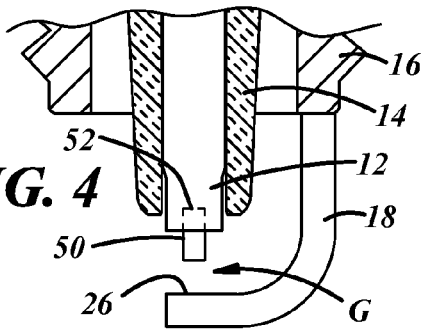
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
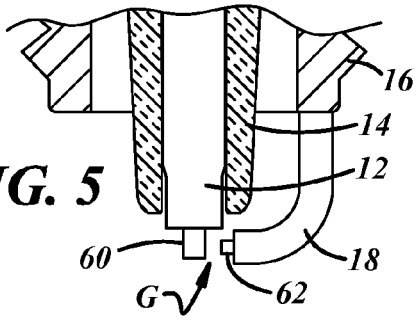
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
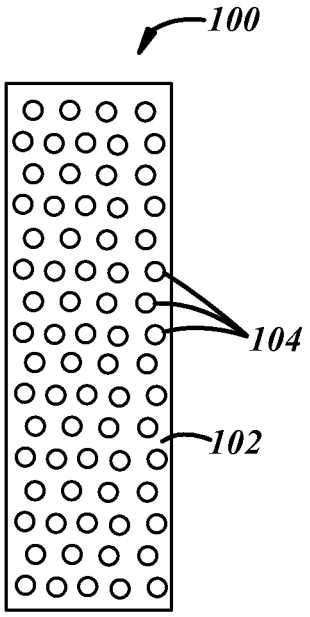
FIG. 6 is a schematic cross-sectional illustration of an exemplary electrode material, where the electrode material has a metal ceramic composite structure that includes a matrix component and a particulate component.
Figure 7:
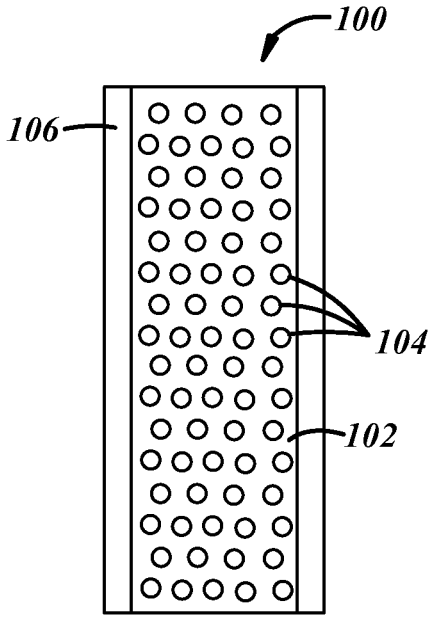
FIG. 7 is a schematic cross-sectional illustration of the exemplary electrode material of FIG. 6, where the electrode material further includes a cladding structure.
Figure 8:
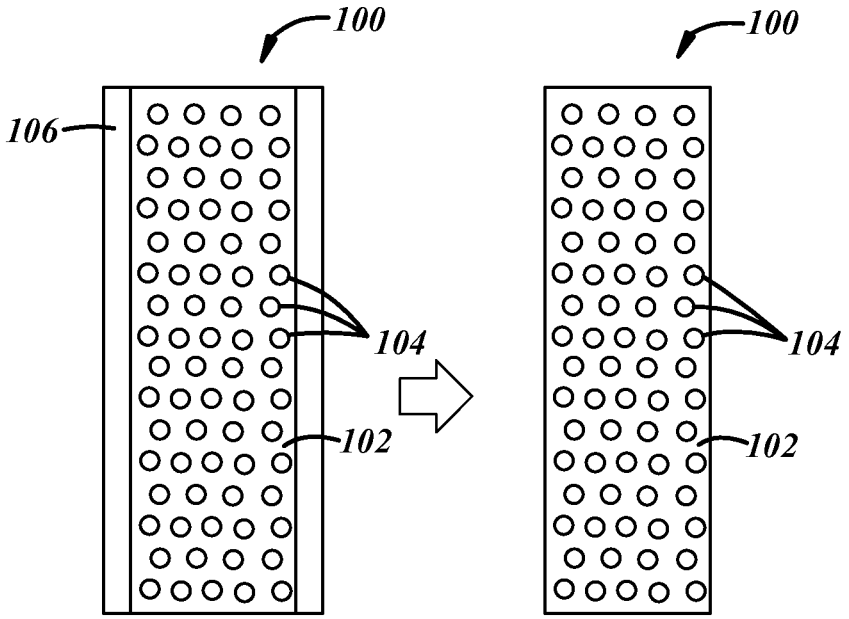
FIG. 8 is a schematic cross-sectional illustration of the exemplary electrode material of FIG. 7, where the cladding structure is subsequently removed via a chemical etching or other process.

The electrode material has a metal ceramic composite structure 100 and includes a particulate component 104 embedded or dispersed within a matrix component 102, as shown in the exemplary embodiments illustrated in FIGS. 6, 7 and 8. The particulate component 104 and the matrix component 102 may exist as separate and discrete phases within the metal ceramic composite structure 100, and may have different chemical compositions and different chemical and mechanical properties. Accordingly, the particulate component 104 and the matrix component 102 can each contribute a separate set of desirable attributes or characteristics to the electrode material, which, in combination, can improve the overall performance of the spark plug. For example, the combination of the particulate component 104 and the matrix component 102 in the metal ceramic composite structure 100 provides the electrode material with high wear resistance, including significant resistance to spark erosion, chemical corrosion and/or oxidation, as well as suitable ductility for manufacturing. According to different exemplary embodiments, the matrix component 102 may account for about 60.0-99.5 wt % of the overall electrode material and the particulate component 104 may account for about 0.5-40.0 wt % of the overall electrode material; the matrix component 102 may account for about 80.0-99.5 wt % of the overall electrode material and the particulate component 104 may account for about 0.5-20.0 wt % of the overall electrode material; and the matrix component 102 may account for about 95.0-99.5 wt % of the overall electrode material and the particulate component 104 may account for about 0.5-5.0 wt % of the overall electrode material. As used herein, the phrase "... wt % of the overall electrode material" means the same thing as "... wt % of the overall metal ceramic composite structure."

The matrix component or phase 102 is the major component of the electrode material and may include a coherent phase of fused particles in which the particulate component or phase 104 is embedded or dispersed. The matrix component 102 is preferably a metal matrix that includes a platinum-based material. The term "platinum-based material," as used herein, broadly includes any material where platinum (Pt) is the single largest constituent of the material, based upon the overall weight of the material. This may include materials having greater than 50 wt % platinum (Pt), as well as those having less than 50 wt % platinum (Pt), so long as platinum (Pt) is the single largest constituent. For example, the platinum-based material may be pure platinum or an alloy of platinum (Pt) and at least one additive metal, such as nickel (Ni) or palladium (Pd). Any of the following alloy systems may be an appropriate platinum-based material for the matrix component: Pt—Ni, Pt—Pd, and Pt—Ni—Pd. The amount of additive metal (e.g., Ni, Pd, a different additive metal, or a combination thereof) may range from about 0.5 wt % to about 30.0 wt % of the matrix component, depending on the type of sintering process that is used.

According to some embodiments where the additive metal content is rather low, the electrode material may be made using a liquid phase sintering process. For instance, when the total additive metal content (e.g., the total content of nickel (Ni), palladium (Pd) or both) is from about 0.5-5.0 wt % of the matrix component, then a liquid phase sintering process may be appropriate. A liquid phase sintering process may be even more preferable when the total additive metal content is from about 1.0-2.0 wt % of the matrix component. According to other embodiments where the additive metal content is higher, the electrode material may be made using a solid phase sintering process. As an example, a matrix component having a total additive metal content from about 5.0-30.0 wt % may lend itself well to a solid phase or solid state sintering process. A solid phase sintering process may be even more preferable for those matrix components where the total additive metal content is from about 10.0-20.0 wt % of the matrix component. One potential factor for determining which type of sintering process is most appropriate (i.e., liquid versus solid phase sintering) is the amount of additive metal in the platinum-based material of the matrix component; if there is too much additive metal, which generally has a lower melt temperature than the other constituents, this can result in too much melted material for a liquid phase sintering process. Thus, liquid phase sintering is usually suitable when the additive metal content is between about 0.5-5 wt % of the matrix component. This concept is explained in more detail below.

Figure 10:
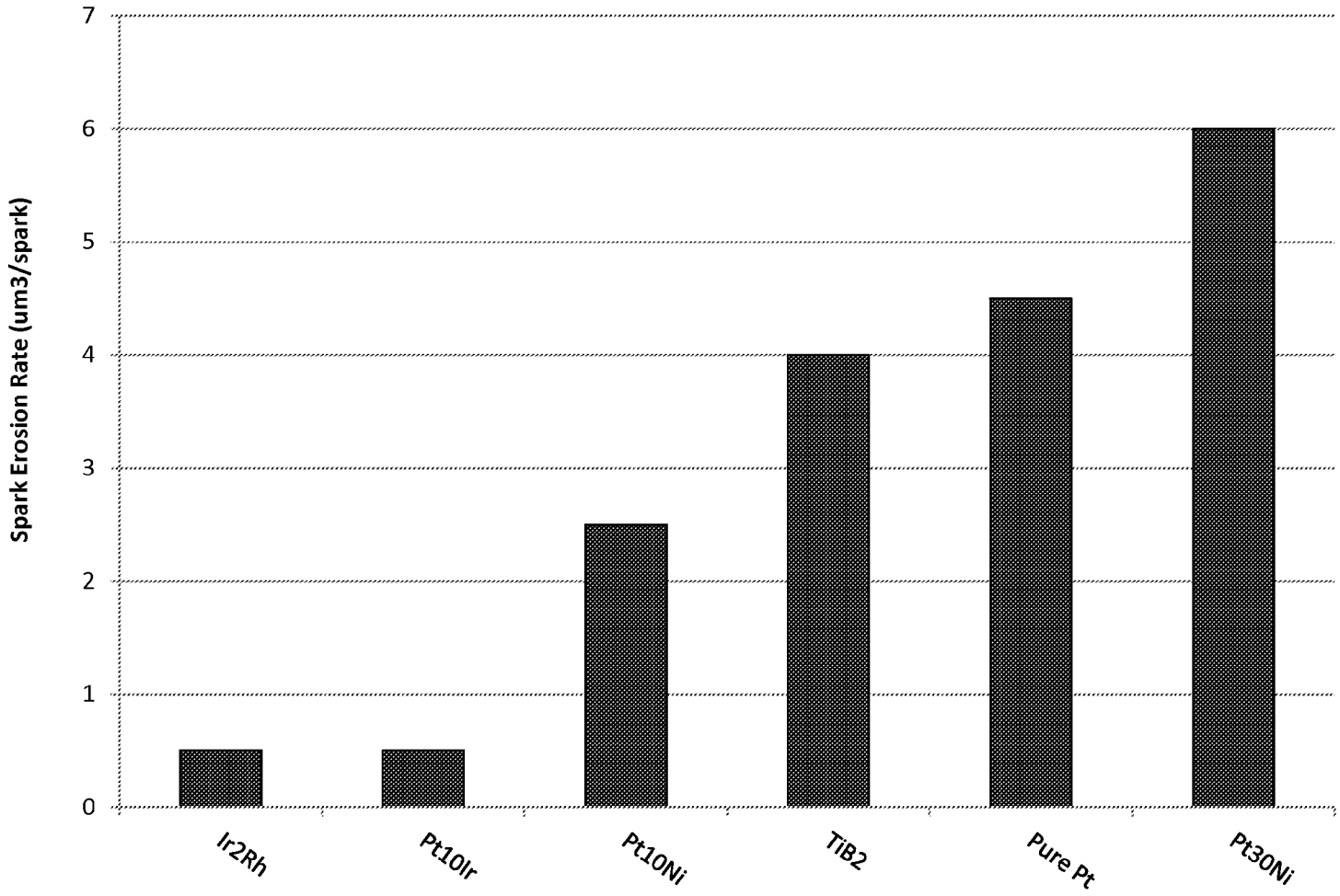
FIG. 10 is a graph showing the results of a hot spark erosion test, which compares the spark erosion performance of several different materials, including some of the proposed compositions for the matrix component.

Some non-limiting examples of potential compositions for the platinum-based material of the matrix component 102 include (the following compositions are given in weight percentage as it pertains to the matrix component, not the overall electrode material; Pt constitutes the balance): Pt-30Ni; Pt-25Ni; Pt-20Ni; Pt-15Ni; Pt-10Ni; Pt-5Ni; Pt-2Ni; Pt-1Ni; Pt-0.5Ni; Pt-20Pd; Pt-15Pd; Pt-10Pd; Pt-5Pd; Pt-2Pd; Pt-1Pd; Pt-0.5Pd; Pt-30Ni-20Pd; Pt-25Ni-15Pd; Pt-20Ni-10Pd; Pt-15Ni-10Pd; Pt-10Ni-5Pd; Pt-10Ni-10Pd; Pt-4Ni-1Pd; Pt-3Ni-2Pd; Pt-2Ni-2Pd; Pt-2Ni-1Pd; Pt-1Ni-1Pd; Pt-1Ni-0.5Pd and Pt-0.5Ni-0.5Pd. With reference to FIG. 10, there is a graph showing the results of a hot spark erosion test (775° C. at 20 KV), which surprisingly illustrates that some matrix component compositions, such as Pt-10Ni, actually exhibit lower spark erosion than pure platinum (Pt). Thus, the one or more additive metal(s) of the matrix component not only influence the material's ability to be processed with a liquid phase sintering process, as explained herein, but the additive metal(s) may also improve the electrical erosion resistance of the material.

The particulate component or phase 104 of the electrode material includes a number of electrically conductive ceramic particles that are generally uniformly dispersed and embedded within the matrix component 102. As used herein, the term "electrically conductive ceramic" means a ceramic material having an electrical conductivity of greater than $1.0\times10^6$ S/m. Some suitable electrically conductive ceramic materials include titanium diboride ($TiB_2$), zirconium diboride ($ZrB_2$), and hafnium diboride ($HfB_2$). For example, titanium diboride ($TiB_2$) typically has an electrical conductivity of about $8\times10^6$ S/m, zirconium diboride ($ZrB_2$) typically has an electrical conductivity of about $10\times10^6$ S/m, and hafnium diboride ($HfB_2$) typically has an electrical conductivity of about $9.1\times10^6$ S/m. For comparison, the electrical conductivity of nickel (Ni) is typically about $14\times10^6$ S/m. In addition to being electrically conductive, these materials also have high melting temperatures and high oxidation resistance at temperatures of at least 1000° C. Accordingly, these electrically conductive ceramic materials may provide the electrode material with suitable resistance to spark erosion, even at the high temperatures normally encountered in combustion chambers of an internal combustion engines (e.g., temperatures in the range of about 800° C. to about 1000° C.). The particulate component 104 may include a number of particles having a mean particle diameter of about 1-20 μm.

The particulate component 104 of the electrode material may be pure titanium diboride ($TiB_2$), zirconium diboride ($ZrB_2$), or hafnium diboride ($HfB_2$), or the particulate component 104 may be a mixture or other combination of titanium diboride ($TiB_2$), zirconium diboride ($ZrB_2$), and hafnium diboride ($HfB_2$). For instance, any of the following combinations may be appropriate for the particulate component: $TiB_2$—$ZrB_2$, $TiB_2$—$HfB_2$, $ZrB_2$—$HfB_2$, and $TiB_2$—$ZrB_2$—$HfB_2$. According to several embodiments, the amount of electrically conductive ceramic particles in the overall electrode material may be: greater than or equal to 0.5 wt %, 1.0 wt %, 2.0 wt % or 5.0 wt %; less than or equal to 20.0 wt %, 15.0 wt %, 10.0 wt % or 5.0 wt %; or between 0.5-20.0 wt %, 0.5-15.0 wt %, 0.5-10.0 wt % or 0.5-5.0 wt %.

The following non-limiting examples of electrode materials may be used to make a ground electrode, a center electrode, or both, according to the meaning of "electrode," as provided above (in the following compositions which pertain to the overall electrode material, the nickel (Ni) contents are between about 0.5-30.0 wt %, the palladium (Pd) contents are between about 0.5-20.0 wt %, and the Pt constitutes the balance): Pt—Ni-(0.5-20)$TiB_2$; Pt—Pd-(0.5-20)$TiB_2$; Pt—Ni—Pd-(0.5-20)$TiB_2$; Pt—Ni-(0.5-5)$TiB_2$; Pt—Pd-(0.5-5)$TiB_2$; Pt—Ni—Pd-(0.5-5)$TiB_2$; Pt—Ni-(0.5-20)$ZrB_2$; Pt—Pd-(0.5-20)$ZrB_2$; Pt—Ni—Pd-(0.5-20)$ZrB_2$; Pt—Ni-(0.5-5)$ZrB_2$; Pt—Pd-(0.5-5)$ZrB_2$; Pt—Ni—Pd-(0.5-5)$ZrB_2$; Pt—Ni-(0.5-20)$HfB_2$; Pt—Pd-(0.5-20)$HfB_2$; Pt—Ni—Pd-(0.5-20)$HfB_2$; Pt—Ni-(0.5-5)$HfB_2$; Pt—Pd-(0.5-5)$HfB_2$ or Pt—Ni—Pd-(0.5-5)$HfB_2$. Some specific, non-limiting examples of electrode materials having metal ceramic composite structures that appear to be quite suitable for use in spark plugs for automotive engines include the following (in the following compositions which pertain to the overall electrode material, the platinum (Pt) constitutes the balance): Pt-(0.5-30)Ni-(0.5-5)$TiB_2$, Pt-(0.5-20)Pd-(0.5-5)

$TiB_2$ and Pt-(0.5-30)Ni-(0.5-20)Pd-(0.5-5)$TiB_2$. Of course, the electrode material is not limited to the specific examples provided above, as other materials may be used, including other materials where additional constituents are added to the compositions listed above and other materials having different constituent percentages.

Figure 9:
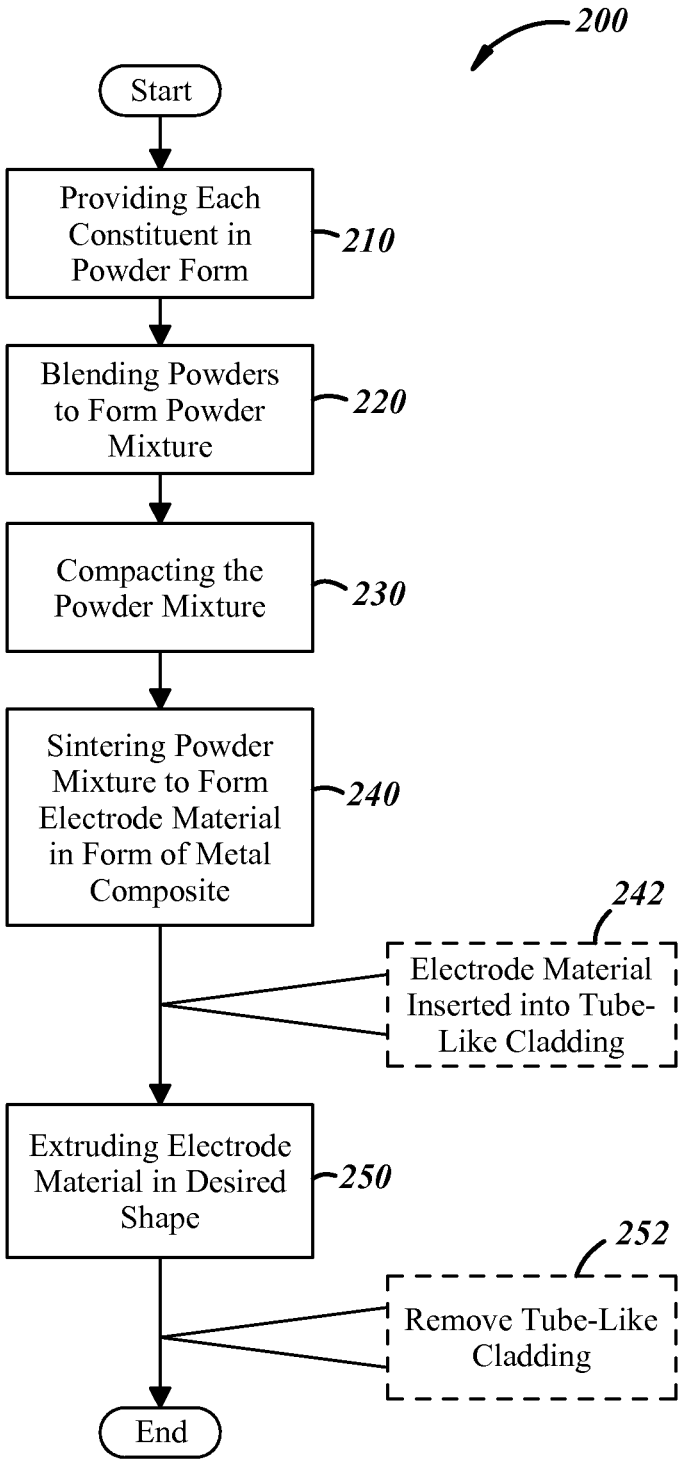
FIG. 9 is a flowchart illustrating an exemplary embodiment of a method of preparing an electrode material for a spark plug.

The electrode material may be produced by a variety of manufacturing processes, such as powder metallurgical processes. For instance, FIG. 9 illustrates an exemplary process 200 that can be used to prepare the electrode material and to form the electrode material into a desired shape, such as that of a spark plug electrode. The process 200 includes the steps of: (i) providing the constituents of the matrix component 102 and the particulate component 104 in powder form, step 210; (ii) blending the constituents together to form a powder mixture, step 220; (iii) consolidating or compacting the powder mixture, step 230; (iv) sintering (either liquid or solid phase sintering) the compacted powder mixture to form the electrode material, step 240; and (v) extruding, drawing or otherwise forming the electrode material into a desired shape, such as a spark plug electrode, step 250. The process 200 may further include one or more optional steps. For example, a cladding or sheathing may optionally be provided around the electrode material before it is extruded, step 242. Thereafter, the cladding or sheath optionally may be removed from the electrode material, step 252.

In step 210, the constituents of the matrix component and the particulate component are provided in powder form. In one embodiment, the different constituents of the matrix component (i.e., the platinum and one or more additive metals) are provided as separate non-alloyed powders that have not yet been formed into a platinum-based alloy. The different matrix powders may have a mean particle diameter in the range of about 1 μm to about 500 μm, inclusive. In another embodiment, the constituents of the matrix component are first pre-alloyed into a platinum-based alloy (e.g., Pt—Ni, Pt—Pd or Pt—Ni—Pd may be pre-alloyed) and are then provided as a pre-alloyed powder before they are mixed with the particulate component, which is an electrically conductive ceramic in powder form. In such a case, the pre-alloy powder may have a mean particle diameter that is different from the mean particle diameter of the particulate component. For example, the pre-alloy powder may have a mean particle diameter of about 1-100 μm, inclusive, and the powder form of the particulate component may have a mean particle diameter of about 1-20 μm, inclusive.

Depending on the particular properties that are desired, the mass or weight ratio of additive metal to platinum (e.g., either Ni:Pt or Pd:Pt) in the pre-alloyed powder may be in the range of about 0.005-0.429. Some exemplary weight percentages of additive metals in the pre-alloyed powder, as well as their corresponding mass ratios of additive metal to platinum (Pt), are provided below in TABLE I.

TABLE I

Exemplary Pre-Alloy Powder Compositions

| Weight % Additive Metal | Mass Ratio of Additive Metal to Platinum |
|---|---|
| 0.5 | 0.005 |
| 2.0 | 0.020 |
| 5.0 | 0.053 |
| 10.0 | 0.111 |
| 20.0 | 0.250 |
| 30.0 | 0.429 |

The powder constituents of the matrix component and the particulate component may then be mixed or blended together in step 220 to form a powder mixture, which can then be compacted into a desired shape or form in step 230. The powder mixture may be compacted with or without the addition of heat. For example, the powder mixture may be compacted at room temperature (e.g., a temperature in the range of about 20-30° C.). Thereafter, in step 240, the compacted powder mixture is sintered to form an electrode material with a metal ceramic composite structure that has a particulate component embedded within a matrix component.

During the sintering step 240, the compacted powder mixture is heated such that the particles fuse together and form one solid piece. The powder mixture may be sintered in a vacuum or in a protective environment, for example, in a reducing atmosphere of argon (Ar) or hydrogen ($H_2$) gas. Pressure (e.g., about 25 MPa) may be applied to the powder mixture during the sintering step 240, if desired. The temperature at which the powder mixture is heated will depend upon the melting temperature of each of the constituents of the powder mixture, and upon the type of sintering process employed. Some exemplary constituents of the electrode material, as well as their corresponding melting temperatures, are provided below in TABLE II.

TABLE II

Melting Temperatures of Exemplary Constituents

| | Melting Temperature (° C.) |
|---|---|
| Metals | |
| Platinum (Pt) | 1768 |
| Palladium (Pd) | 1555 |
| Nickel (Ni) | 1455 |
| Ceramics | |
| Titanium Diboride ($TiB_2$) | 3225 |
| Zirconium Diboride ($ZrB_2$) | 3246 |
| Hafnium Diboride ($HfB_2$) | 3250 |

The inclusion of the additive metal in the matrix component (i.e., the type and amount of additive metal) can influence both the melting temperature and the sintering temperature, and can affect the type of sintering process that is used. If the additive metal is nickel (Ni), the powder mixture may be sintered at a temperature in the range of about 1000-1550° C. On the other hand, if the additive metal is palladium (Pd), the powder mixture may be sintered at a temperature in the range of about 1000-1650° C. If the additive metal includes both nickel (Ni) and palladium (Pd), the powder mixture may be sintered at a temperature in the range of about 1000-1650° C.

In one embodiment, the electrode material is formed using a liquid phase sintering process, where the powder mixture is heated to a sintering temperature that is above the melting temperature of the additive metal, but below the melting temperature of the platinum (Pt) and the electrically conductive ceramic. Particles of the additive metal can then melt along the grain boundaries of the platinum (Pt) and the ceramic particles such that it better fuses these various particles together; this may create inter-diffused boundaries between the additive metal and the platinum (Pt) and/or the electrically conductive ceramic particles. The liquid phase sintering process described above is most suitable when the total amount of additive metal(s) only constitutes about 0.5-5.0 wt % of the matrix component (i.e., when the mass ratio of total additive metal(s) to platinum is between about 0.005 and 0.053); too much additive metal can result in too much melting for a liquid phase sintering process, thus, the preference that the total amount of additive metal(s) be between 0.5-5 wt %. If the total amount of additive metal(s) in the matrix component is from about 5.0-30.0 wt %, then a solid phase sintering process is preferred. As mentioned above, it is possible to use a single additive metal like nickel (Ni) or palladium (Pd), or a combination of additive metals such as nickel (Ni) and palladium (Pd). The percentage ranges above, which help dictate the most suitable type of sintering process, are based on the total amount of additive metals in the matrix component, in the event that more than one additive metal is used (e.g., Ni and Pd). If the additive metal is nickel (Ni), the liquid phase sintering temperature may be between about 1400-1550° C.; and if the additive metal is palladium (Pd), the liquid phase sintering temperature may be between about 1500-1650° C.

In the case of solid phase or solid state sintering processes, the powder mixture is heated to a temperature that is below the melting temperature of the additive metal, as well as that of the platinum (Pt) and the electrically conductive ceramic. In this embodiment, a mutual diffusion will take place, with atoms of platinum (Pt) and of the additive metal diffusing across particle boundaries, thereby fusing the different particles together without necessarily flowing as a liquid. If the additive metal is nickel (Ni), the solid state sintering process may be performed at a temperature in the range of about 1000-1300° C.; and if the additive metal is palladium (Pd), the solid state sintering process may be performed at a temperature in the range of about 1000-1300° C.

After the sintering step 240 has been performed, the electrode material will typically exhibit a multi-phase microstructure, as generally and schematically illustrated in FIGS. 6, 7 and 8, where a metal ceramic composite structure 100 has a matrix component 102 that is distinct or distinguishable from a particulate component 104. The matrix component 102 of the electrode material may include a generally uniform or homogeneous platinum-based material or alloy. For example, the matrix component 102 may include a binary alloy of platinum and nickel (Pt—Ni) or of platinum and palladium (Pt—Pd), or a ternary alloy of platinum, nickel and palladium (Pt—Ni—Pd), where in each case Pt is the single largest constituent. Of course, other constituents or materials may also be included in the matrix component. The particulate component 104 may include a number of electrically conductive ceramic particles that are generally uniformly dispersed and embedded within the matrix component 102. The ceramic particles may be present along the grain boundaries of the matrix component 102 and within the grains themselves.

Next, in step 250, the electrode material may be extruded, drawn or otherwise formed into a desired shape. If an elongated wire is desired to form a number of spark plug firing tips, then the electrode material may be cold extruded to form a fine wire having a diameter of about 0.3 mm to about 1.5 mm, inclusive, which in turn can be cut or cross-sectioned into individual pieces of a desired length. These individual pieces of the electrode material may be directly or indirectly attached to the center and/or ground electrodes of a spark plug in order to form the sparking portion or firing tip thereof. In other embodiments, the formed electrode material may be used directly as the actual central and/or ground electrode itself.

As mentioned above, it is also possible for process 200 to include an optional step where a cladding or sheath made of a different material is added to the electrode material, so that the combined electrode material and cladding can be co-extruded during step 250. In one embodiment, an additional optional step 242 is provided where the already sintered electrode material from step 240 is inserted or stuffed into a tube-like cladding structure 106, as illustrated in FIG. 7. The cladding structure 106 may be precious metal-based, copper-based, zinc-based or nickel-based, for example. In the event that cladding structure 106 is precious metal-based, the cladding or sheathing may include pure platinum (Pt), pure palladium (Pd), pure gold (Au), pure silver (Ag) or some alloy thereof. In the example of a copper-based cladding structure, oxygen-free copper (Cu) is an acceptable choice. Zinc-based cladding structures may be used in instances where it is desirable to have a high degree of lubrication during the extrusion process. Other cladding materials are also possible. A cladding structure 106 having an outer diameter of about 0.3-1.5 mm and a cladding wall thickness of less than about 150 μm may be used.

In the exemplary copper-based, zinc-based and nickel-based cladding examples introduced above, once the electrode and cladding materials have been co-extruded, the cladding structure 106 may be removed by chemical etching or some other suitable technique, optional step 252. This process is generally and schematically illustrated in FIG. 8. In these examples, the cladding structure is used to facilitate the extrusion process but is removed thereafter so that the resulting electrode material can be formed into a spark plug electrode without any cladding. In the precious metal-based examples above, the cladding may be left intact after the co-extrusion process; that is, the cladding can be left on the electrode and can act as a thin protective outer layer.

The process 200 described above may be used to form the electrode material into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting, grinding, hot- or cold-metal working techniques that are sometimes difficult to use with other known erosion-resistant electrode materials. Moreover, the particular number and sequence of steps in the exemplary process 200 may be altered, as the present process is not strictly limited thereto.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both the center and ground electrodes include an electrode material with a metal ceramic composite structure that has a particulate component embedded in a matrix component, and the matrix component includes a platinum-based material and constitutes about 80.0-99.5 wt % of the electrode material, and the particulate component includes an electrically conductive ceramic and constitutes about 0.5-20.0 wt % of the electrode material.

2. The spark plug of claim 1, wherein the matrix component includes a platinum-based material that includes platinum (Pt) and at least one additive metal, and the platinum (Pt) is the single largest constituent of the platinum-based material on a wt % basis.

3. The spark plug of claim 2, wherein the platinum-based material includes at least one additive metal that constitutes about 0.5-30.0 wt % of the matrix component.

4. The spark plug of claim 2, wherein the platinum-based material includes at least one additive metal that is selected from the group consisting of nickel (Ni) or palladium (Pd).

5. The spark plug of claim 4, wherein the platinum-based material includes at least one alloy that is selected from the group consisting of: Pt—Ni, Pt—Pd, or Pt—Ni—Pd.

6. The spark plug of claim 1, wherein the particulate component includes at least one electrically conductive ceramic that is selected from the group consisting of: titanium diboride ($TiB_2$), zirconium diboride ($ZrB_2$), or hafnium diboride ($HfB_2$).

7. The spark plug of claim 1, wherein the particulate component includes particles that have a mean particle diameter of about 1 μm to about 20 μm.

8. The spark plug of claim 1, wherein the electrode material has a liquid phase sintered metal ceramic composite structure that includes inter-diffused boundaries between melted particles of at least one additive metal and particles of the matrix component or particles of the particulate component.

9. The spark plug of claim 1, wherein the electrode material has a solid phase sintered metal ceramic composite structure that includes boundaries between non-melted particles of at least one additive metal and particles of the matrix component or particles of the particulate component.

10. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both the center and ground electrodes include an electrode material with a metal ceramic composite structure that has a particulate component and a matrix component, and the matrix component is a platinum-based alloy in which the particulate component is dispersed, wherein the platinum-based alloy includes at least one additive metal that is selected from the group consisting of nickel (Ni) or palladium (Pd), and the particulate component includes an electrically conductive ceramic that is selected from the group consisting of titanium diboride ($TiB_2$), zirconium diboride ($ZrB_2$), or hafnium diboride ($HfB_2$).

* * * * *